US005858632A

United States Patent [19]

Taguchi

[11] Patent Number: 5,858,632

[45] Date of Patent: Jan. 12, 1999

[54] PROCESSING METHOD OF SILVER HALIDE LIGHT SENSITIVE PHOTOGRAPHIC MATERIAL

[75] Inventor: Masaaki Taguchi, Hino, Japan

[73] Assignee: Konica Corporation, Tokyo, Japan

[21] Appl. No.: 953,621

[22] Filed: Oct. 17, 1997

[30] Foreign Application Priority Data

Oct. 22, 1996 [JP] Japan ..... 8-298188

[51] Int. Cl.[6] ..... G03C 5/26

[52] U.S. Cl. ..... 430/440; 430/446; 430/559; 430/628; 430/641

[58] Field of Search ..... 430/440, 446, 430/559, 628, 641

[56] References Cited

U.S. PATENT DOCUMENTS 4,035,184 7/1977 Faul et al. ..... 430/393
4,362,806 12/1982 Whitmore ..... 430/202

FOREIGN PATENT DOCUMENTS 4-138448 5/1992 Japan .

*Primary Examiner*—Hoa Van Le
*Attorney, Agent, or Firm*—Frishauf, Holtz, Goodman, Langer & Chick, P.C.

[57] ABSTRACT

A method for processing a silver halide light sensitive photographic material comprising a support having thereon hydrophilic colloid layers including a silver halide emulsion layer, wherein a dextran and a leuco dye compound each are independently contained in the hydrophilic colloid layer(s), the photographic material being processed with a developer containing a reductone as a developing agent.

5 Claims, No Drawings

PROCESSING METHOD OF SILVER HALIDE LIGHT SENSITIVE PHOTOGRAPHIC MATERIAL

FIELD OF THE INVENTION

The present invention is related to a method for processing a silver halide light sensitive photographic material and in particular to a processing method of a silver halide light sensitive photographic material, which performs with little variation of photographic performance, superior silver image tone and image lasting quality, and can be carried out at a low replenishing rate without pollution of the working environment.

BACKGROUND OF THE INVENTION

Silver halide light sensitive photographic materials for use in medical diagnosis are conventionally developed using, as a developing agent, dihydroxybenzenes such as hydroquinone. In a developer containing the dihydroxybenzenes, however, a preservative such as sulfites must be included to maintain storage stability, and it is undesirable in terms of worker's safety. There is also a disadvantage such that the developer causes color change upon aerial oxidation, leading to color staining.

There is known a technique of using reductones as a developing agent in place of the dihydroxybenzenes. The reductones cause no color stain due to oxidation, and ascorbic acid or erythorbic acid is generally employed as a food additive, having advantages such that it is safe for living organisms.

However, a developer containing reductones is easily oxidized under alkaline conditions and is hydrolyzed to give off an acid, which lowers the pH of the developer and disadvantageously results in large variations in processed photographic materials.

Since 1995, open sea disposal of photographic processing effluent has been prohibited, resulting in effluent being incinerated. Such a land-based treatment of the processing effluent results in a rise in energy and cost. Further, the processing effluent itself is limited so that reduction of a replenishing rate is desired. However, the reduction of the replenishing rate prolongs the time of the processing solution in a processing bath, causes oxidative exhaustion of processing solutions, and lowers the density or contrast of processed photographic materials, leading to deterioration of processing stability.

In terms of emergent medical treatment, rapid access to image information is required to quickly diagnose the patient's state and prompt treatment so that rapid processing of photographic material is strongly desired.

As a means for meeting these desires is a technique known of increasing covering power of developed silver to reduce the silver coating amount by means of, e.g., decreasing the average grain size or using tabular grains with a high aspect ratio and small grain thickness. However, such grains capable of providing high covering power tend to produce yellowish developed silver images, leading to deteriorated silver image tone. This is due to the fact that the developed silver decreases in size and thickness with a decrease of the grain size and thickness, resulting in increased scattering of blue light.

As another means for responding to the desire for rapid processing is a technique known of incorporating a dextran into the binder. However, it has the problem of incorporation of the dextran which deteriorates silver image tone. To improve deterioration of the silver image tone, there is known a technique of incorporating a dye capable of remaining in a photographic material after processing. In this case, however, unnecessary dye remains in unexposed portions, resulting in deterioration in residual color. There is further a technique in which a support is previously tinted with a blue dye. Taking account of deterioration of diagnosis due to an increase of fog density, in this case, it is impossible to tint to an extent sufficient for improving silver image tone. In view the foregoing, further means for solving these problems are desired. Furthermore, medical diagnostic photographs are obligated to be retained over a long period of time (at least five years) from requirements to observe the course of disease so that storage stability without image deterioration over a long period of time is essential.

SUMMARY OF THE INVENTION

An objective of the present invention is to provide a processing method of a silver halide light sensitive photographic material, which performs with little variation of photographic performance, possesses superior silver image tone and image lasting quality, and can be carried out at a low replenishing rate, without causing pollution of the work environment.

The above objective can be accomplished by the following:

(1) a method for processing a silver halide light sensitive photographic material comprising a support having thereon hydrophilic colloid layers including a silver halide emulsion layer, wherein a dextran and a leuco dye compound each are independently contained in the hydrophilic colloid layer(s), and the photographic material being processed with a developer containing a reductone as a developing agent;

(2) the processing method described in (1), wherein the leuco dye compound is represented by the following formulas (I) through (VII):

Formula (I)

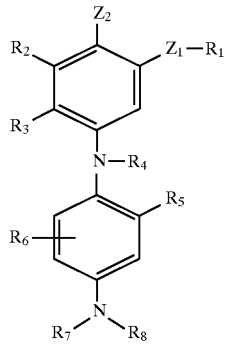

Formula (II)

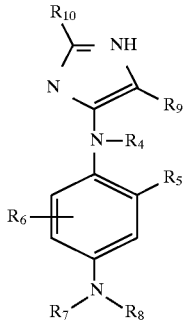

-continued

Formula (III)

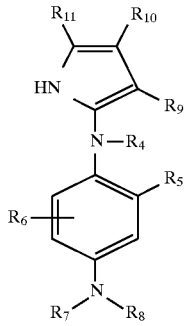

Formula (IV)

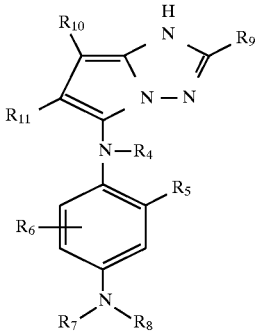

Formula (V)

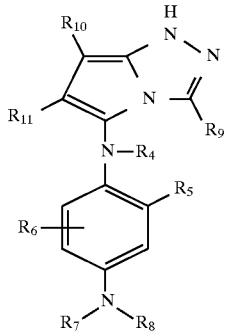

Formula (VI)

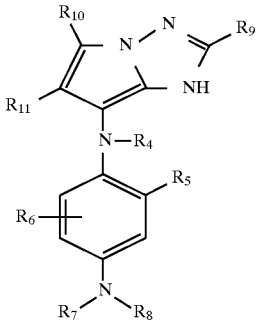

Formula (VII)

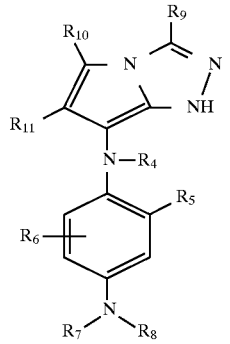

where $Z_1$ represents —NHCO—, —CONH— or —NHCONH—; $Z_2$ represents —OH or —$NHSO_2R_{12}$, in which $R_{12}$ represents an alkyl group or an aryl group; $R_1$ represents an aryl group of a heterocyclic group; $R_2$ represents a hydrogen atom, an alkyl group or a halogen atom and $R_3$ represents a hydrogen atom, an alkyl group or an acylamino group, or $R_2$ and $R_3$ combine with each other to form a ring; $R_4$ represents a hydrogen atom, —$COR_{13}$, or —$SO_2R_{13}$, in which $R_{13}$ represents an alkyl group or an aryl group; $R_5$ and $R_6$ each represent a hydrogen atom, an alkyl group, an alkoxy group, an acylamino group or a halogen atom; $R_7$ and $R_8$ each represent a hydrogen atom, an alkyl group, an aryl group or an acyl group, or $R_7$ and $R_8$ may combine with each other to form a 5 or 6-membered nitrogen-containing heterocyclic ring or may also represent the carbon atoms necessary to form a fused ring with the phenyl ring to which the N atom is attached; $R_9$, $R_{10}$ and $R_{11}$ each represent a hydrogen atom or a substituent, provided that $R_{10}$ and $R_{11}$ may combine with each other to form a ring;

(3) the processing method described in (2), wherein the content of the dextran is 0.3 g/$m^2$ or more; and (4) the processing method described in (3), wherein a developer replenishing rate is 200 ml per $m^2$ of the photographic material or more.

DETAILED DESCRIPTION OF THE INVENTION

Leuco compound

The leuco compound (leuco dye) used in the invention is presented by the afore-mentioned Formulas (I) through (VII): where $Z_1$ represents —NHCO—, —CONH— or —NHCONH—; $Z_2$ represents —OH or —$NHSO_2R_{12}$, in which $R_{12}$ represents an alkyl group or an aryl group; $R_1$ represents an aryl group of a heterocyclic group; $R_2$ represents a hydrogen atom, an alkyl group or a halogen atom and $R_3$ represents a hydrogen atom, an alkyl group or an acylamino group, or $R_2$ and $R_3$ combine with each other to form a ring; $R_4$ represents a hydrogen atom, —$COP_{13}$, or —$SO_2R_{13}$, in which $R_{13}$ represents an alkyl group or an aryl group; $R_5$ and $R_6$ each represent a hydrogen atom, an alkyl group, an alkoxy group, an acylamino group or a halogen atom; $R_7$ and $R_8$ each represent a hydrogen atom, an alkyl group or an acyl group, or $R_7$ and $R_8$ are combined with each other to form a 5 or 6-membered nitrogen-containing heterocyclic ring; $R_9$, $R_{10}$ and $R_{11}$ each represent a hydrogen atom or a substituent, provided that $R_{10}$ and $R_{11}$ may combine with each other to form a ring.

The aryl group represented by $R_1$ is one having 6 to 10 carbon atoms (e.g., phenyl group or naphthyl group), which may be substituted. examples of the substituent include an alkyl group, dialkylamino group, alkoxy group, aryloxy group, halogen atom such as fluorine, chlorine or bromine, alkoxycarbonyl group, acylamino group, carbamoyl group, alkylcarbamoyl group, arylcarbamoyl group, alkylsulfonamido group, arylsulfonamido group, sulfamoyl group, alkylsulfamoyl group, alkylsufonyl group, cyano group and nitro group. The heterocyclic group represented by R such as pyridyl group, quinolyl group, furyl group, benzothiazolyl group, oxazolyl group or imidazolyl group, may be substituted. Substituents include those above-described in the case of the aryl group.

The alkyl group represented by $R_2$ and $R_3$ is preferably one having 1 to 3 carbon atoms, such as methyl, ethyl or propyl. In cases where $R_2$ and $R_3$ combine with each other to form a ring, preferred examples of the ring formed by $R_2$ and $R_3$ include a benzene ring. The halogen atom represented by $_2$, $R_5$ and $R_6$ is F, Cl, Br or I and preferably Cl. The alkyl group represented by $R_5$, $R_6$, $R_7$, $R_8$, $R_{12}$ and $R_{13}$ is a straight-chained or branched alkyl group having 1 to 20 carbon atoms (e.g., methyl, ethyl, n-butyl, t-butyl, n-octyl, n-hexadecyl, etc.), which may be substituted by a substituent (e.g., a halogen atom, alkoxy group, aryloxy group, alkoxycarbonyl group, aryloxycarbonyl group, hydroxy group, acylamino group, carbamoyl group, sulfamoyl group, sulfonamido group, cyano group, etc.).

The aryl group represented by $R_7$, $R_8$, $R_{12}$ and $R_{13}$ is one having 6 to 10 carbon atoms and the same as the aryl group defined in $R_1$.

The alkoxy group represented by $R_5$ and $R_6$ is preferably substituted or unsubstituted one having 1 to 20 carbon atoms (e.g., methoxy, ethoxy, n-butoxy, n-hexyloxy, n-decyloxy, isopropyloxy, 2-methoxyethoxy, 2-chloroethoxy, etc.). The acylamino group represented by $R_3$, $R_5$ and $R_6$ is preferably one having 2 to 30 carbon atoms (e.g., an acetylamino, propionylamino, butylylamino, myristoylamino, stearoylamino, pivaloylamino, benzoylamino, etc.), which may substituted by a substituent (e.g., alkoxy group, phenoxy group, alkyl-substituted phenoxy group, etc.).

The acyl group represented by $R_7$ and $R_8$ is preferably one having 2 to 20 carbon atoms (e.g., acetyl, propionyl, butylyl, benzoyl, lauloylisobutylyl, etc.). The 5 or 6-membered nitrogen-containing heterocyclic ring formed by combination of $R_7$ and $R_8$ includes a piperidine ring, pyrrolidine ring and morpholine ring. $R_7$ and $R_8$ may represent the carbon atoms necessary to form a fused ring with the phenyl ring to which the N atom is attached.

In Formula (I), it is preferred that $R_1$ is an aryl group, $R_2$ is a hydrogen atom and $R_3$ is an acylamino group.

$R_9$, $R_{10}$ and $R_{11}$ each represents a hydrogen atom or a substituent comprised of non-metallic atoms. Thus, $R_9$, $R_{10}$ and $R_{11}$ each represents a hydrogen atom, aryl group, heterocyclic group, alkyl group, cyano group, cyano group, carbamoyl group, alkoxycarbonyl group, aryloxycarbonyl group, acylamino group, alkoxycarbonylamino group, aryloxycarbonylamino group, sulfonylamino group, aminocarbonylamino group, sulfamoylamino group, amino group (including anilino group), alkoxy group, aryloxy group, silyloxy group, heterocyclic-oxy group, alkylthio group, arylthio group, heterocyclic-thio group, halogen atom, hydroxy group, nitro group, sulfamoyl group, sulfonyl group, azo group, acyloxy group, carbamoyloxy group, imido group, sulfinyl group, phospholyl group or azolyl group. Preferred examples $R_9$, $R_{10}$ and $R_{11}$ a hydrogen atom, an aryl group (preferably having 6 to 20 carbon atoms, such as phenyl group, m-acetylaminophenyl group or p-methoxyphenyl group), alkyl group (preferably having 1 to 20 carbon atoms, such as methyl, ethyl, isopropyl, t-butyl, n-octyl or n-dodecyl), cyano group, acyl group (preferably having 1 to 20 carbon atoms, such as acetyl, pivaloyl, benzoyl, furoyl, 2-pyridylcarbonyl), carbamoyl group (preferably having 1 to 20 carbon atoms, such as methylcarbamoyl, ethylcarbamoyl, dimethylcarbamoyl or n-octylcarbamoyl), alkoxycarbonyl group (preferably having 1 to 20 carbon atoms, such as methoxycarbonyl, ethoxycarbonyl or isopropylcarbonyl), aryloxycarbonyl group (preferably having 7 to 20 carbon atoms, such as phenoxycarbonyl, p-methoxycarbonyl, m-chlorophenoxycarbonyl or o-methoxyphenoxycarbonyl), acylamino group (preferably alkylcarbonylamino group having 1 to 20 carbon atoms, such as formylamino, acetylamino, propionylamino or cyanoacetylamino; arylcarbonylamino group having 7 to 20 carbon atoms, such as benzoylamino, p-tolylamino, pentafluorobenzoylamino or m-methoxybenzoylamino; and heterocyclic-carbonylamino group having 4 to 20 carbon atoms, such as 2-pyridylcarbonylamino, 3-pyridylcarbonylamino or furoylamino), alkoxycarbonylamino group (preferably having 1 to 20 carbon atoms, such as methoxycarbonylamino, ethoxycarbonylamino or methoxyethoxycarbonylamino), aryloxycarbonylamino group (preferably having 7 to 20 carbon atoms, such as phenoxycarbonylamino, p-methoxyphenoxycarbonylamino, p-methylphenoxycarbonylamino, m-chlorophenoxycarbonylamino or o-chlorophenoxycarbonylamino), sulfonylamino group (preferably having 1 to 20 carbon atoms, such as methanesulfonylamino, benzenesulfonylamino or toluenesulfonylamino), aminocarbonylamino group (preferably having 1 to 20 carbon atoms, such as methylaminocarbonylamino, ethylaminocarbonylamino, anilionocarbonylamino or dimethylaminocarbonylamino), sulfamoylamino group (preferably having 1 to 20 carbon atoms, such as methylaminosulfonylamino, ethylaminosulfonylamino or anilinosulfonylamino), amino group (including anilino group, preferably having 1 to 20 carbon atoms, such as amino, methylamino, dimethylamino, ethylamino, diethylamino, n-butylamino or anilino), alkoxy group (preferably having 1 to 20 carbon atoms, such as methoxy, ethoxy, isopropoxy, n-butoxy, methoxyethoxy or n-dodecyloxy), aryloxy group (preferably having 6 to 20 carbon atoms, such as pheoxy, m-chlorophenoxy, p-methoxypheoxy or o-methoxypheoxy), silyloxy group (preferably having 3 to 20 carbon atoms, such as trimethylsilyloxy, t-butyldimethylsilyloxy, cetyldimethylsilyloxy or phenyldimethylsilyloxy), heterocyclic-oxy group (preferably having 3 to 20 carbon atoms, such as tetrahydropiranyloxy, 3-pyridyloxy or 2-(1,3-benzoimidazolyl)oxy), alkylthio group (preferably having 1 to 20 carbon atoms, methylthio, ethylthio, n-butylthio or t-butylthio), arylthio group (preferably having 6 to 20 carbon atoms, such as phenylthio), heterocyclic-thio group (preferably having 3 to 20 carbon atoms, such as 2-pyridylthio, 2-(1,3-benzooxazolyl)thio, 1-hexadecyl-1,2,3,4-tetrazolyl-5-thio or 1- (3-N-octadecylcarbamoyl) phenyl-1,2,3,4-tetrazolyl-5-thio), heterocyclic group (preferably having 3 to 20 carbon atoms, such as 2-benzooxazolyl, 2-benzothiazolyl, 1-phenyl-2-benzimidazolyl, 5-chloro-1-tetrazolyl, 1-pyrrolyl, 2-furanyl, 2-pyridyl or 3-pyridyl), halogen atom )fluorane, chlorine, bromine), hydroxy group, nitro group, sulfamoyl group (preferably having 0 to 20 carbon atoms, such as methylsulfamoyl or dimethylsulfamoyl), sulfonyl group (preferably having 1 to 20 carbon atoms, such as methanesulfonyl, benzenesulfonyl or toluenesulfonyl), azo group (preferably having 3 to 20 carbon atoms, such as p-nitrophenylazo), acyloxy group (preferably having 1 to 20 carbon atoms, such as formyloxy, acetyloxy or benzoyloxy), carbamoyloxy group (preferably having 1 to 20 carbon atoms, such as methylcarbamoyloxy or diethylcarbamoyloxy), imido group (preferably having 4 to 20 carbon atoms, such as succinic acid-imido or phthalimido), sulfinyl group (preferably having 1 to 20 carbon atoms, such as diethylaminosulfinyl), phospholyl group (preferably having 0 to 20 carbon atoms, such as diaminophospholyl), and azolyl group (preferably having 2 to 20 carbon atoms, such as 3-pyrazolyl).

Exemplary examples of the compounds represented by Formula (I) through (VII) are shown as below, but the invention is not limited to these examples.

(I-1)
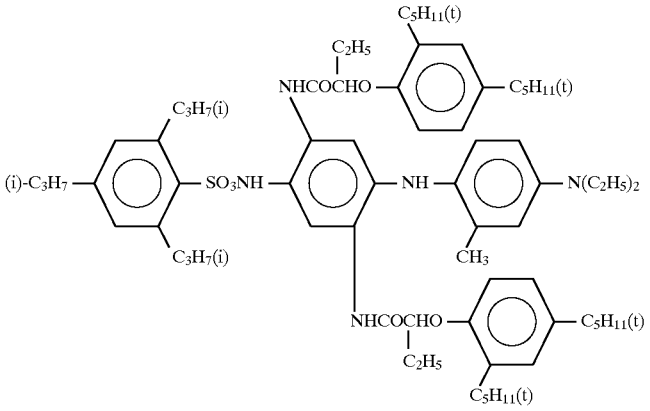
(I-2)
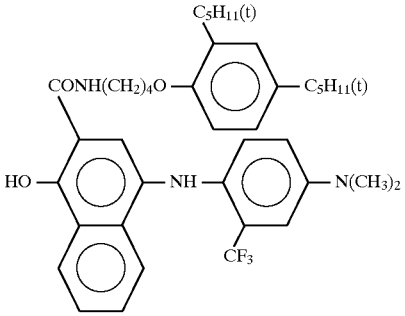
(I-3)
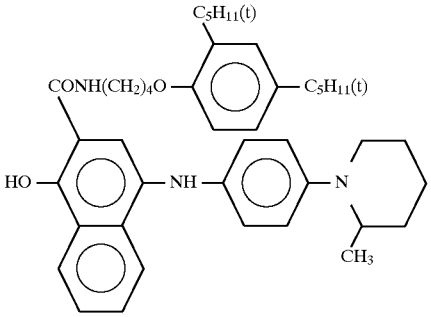
(I-4)
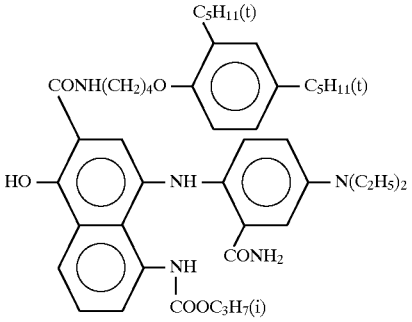

-continued
(I-5)
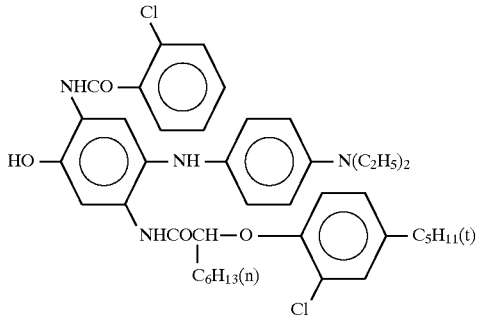
(I-6)
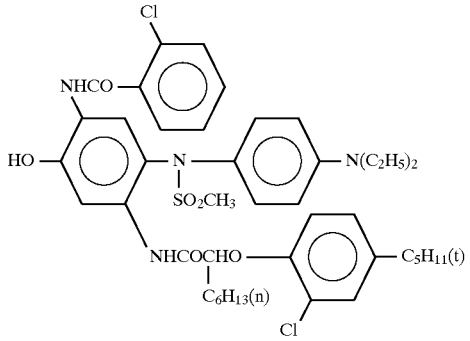
(I-7)
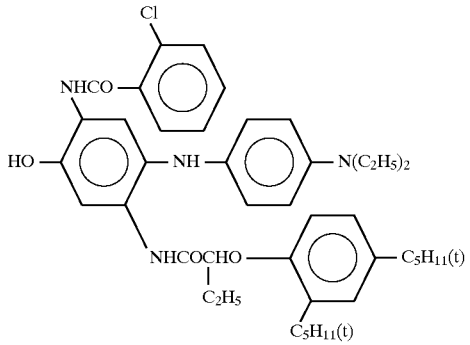
(I-8)
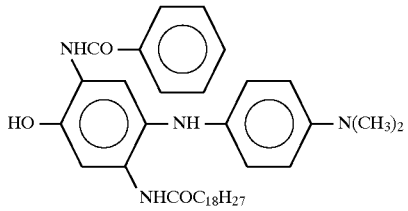
(I-9)
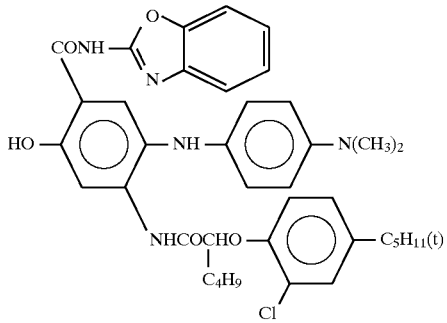

-continued
(I-10)
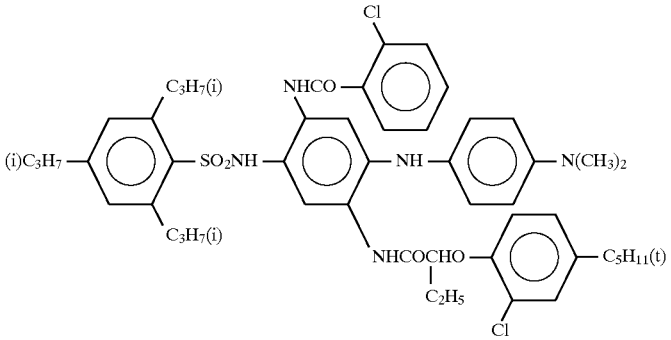
(I-11)
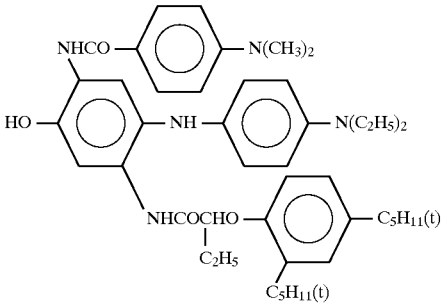
(I-12)
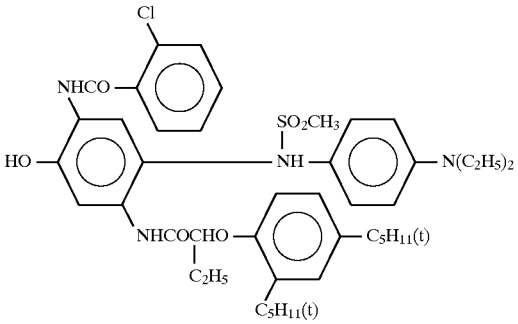
(II-1)
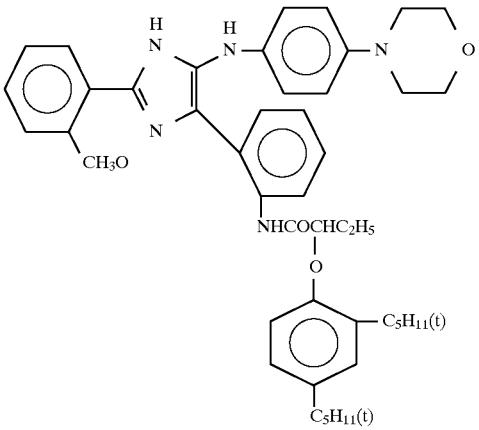
(II-2)
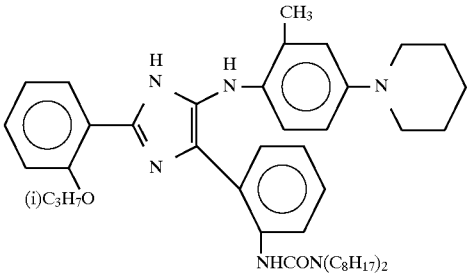

-continued
(II-3)
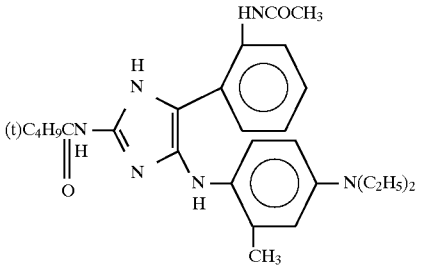
(II-4)
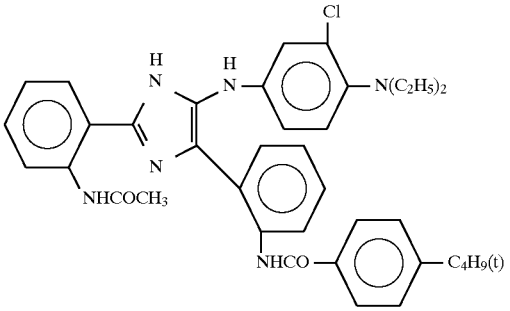
(II-5)
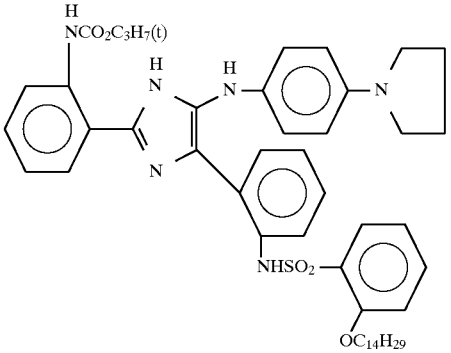
(II-6)
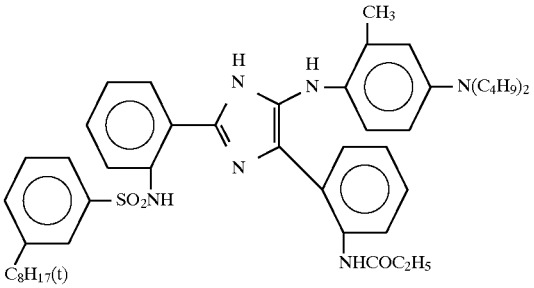
(III-1)
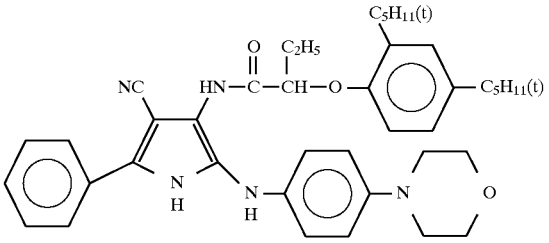

-continued
(III-2)
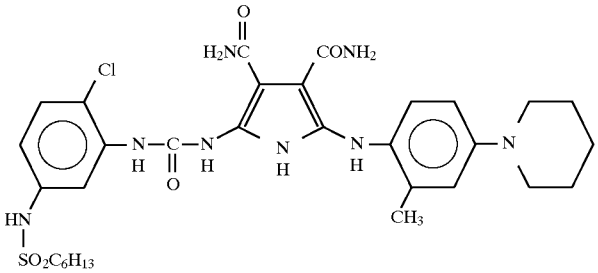
(III-3)
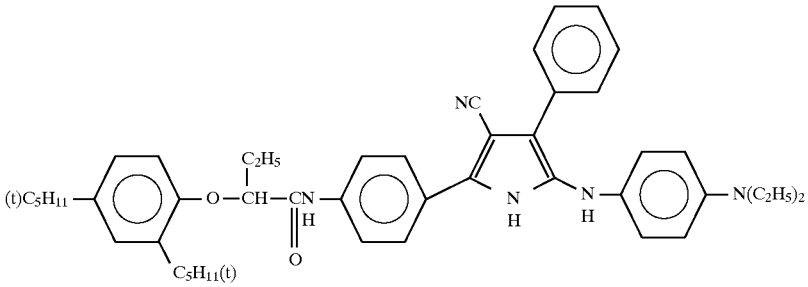
(III-4)
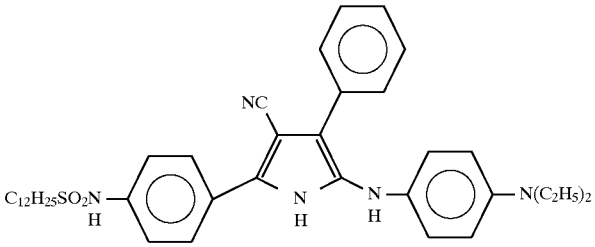
(III-5)
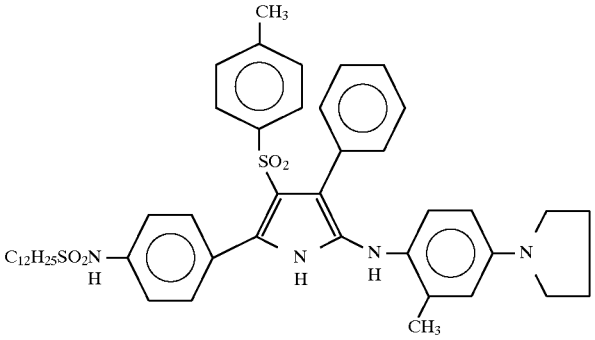
(III-6)
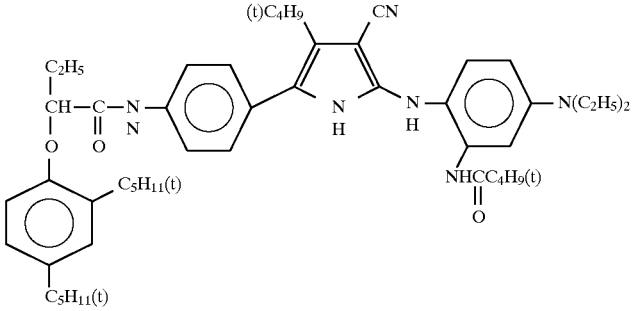

-continued
(IV-1)
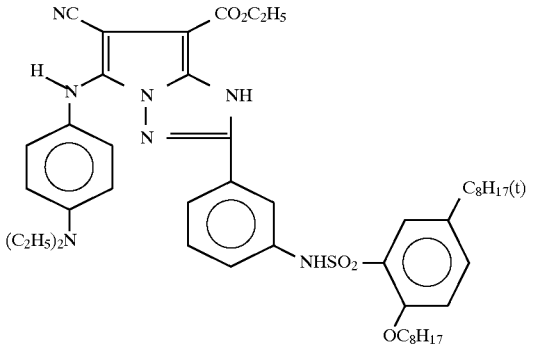
(IV-2)
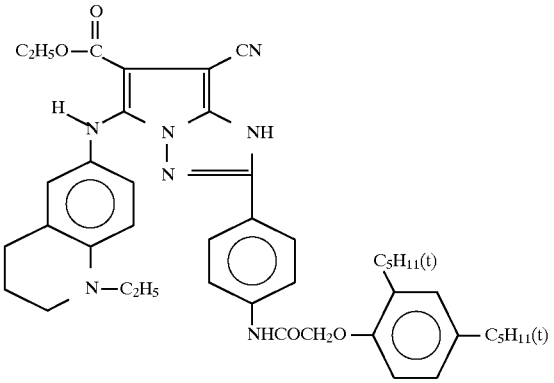
(IV-3)
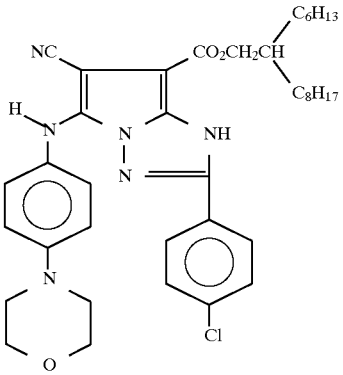
(IV-4)
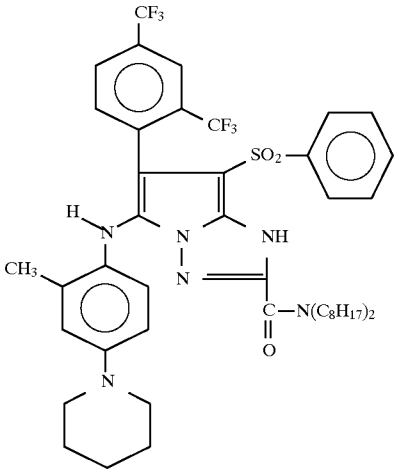

-continued (V-1)

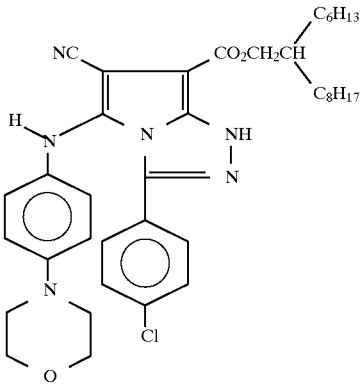

(V-2)

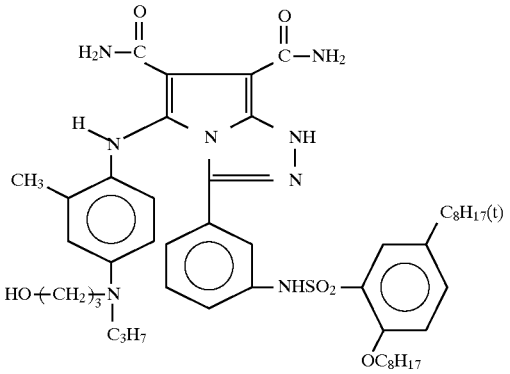

(VI-1)

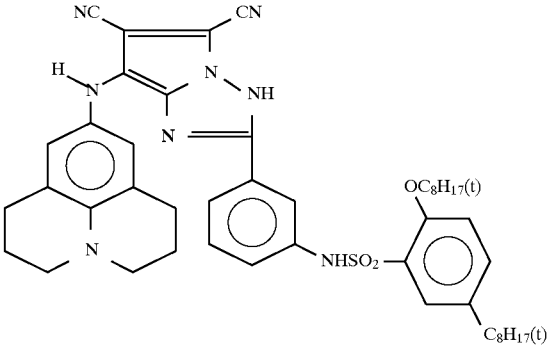

(VII-1)

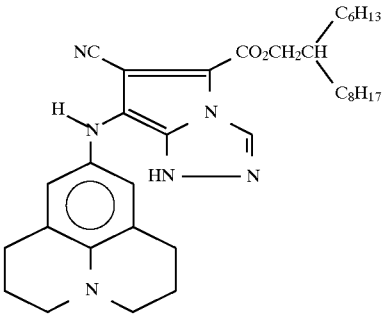

The leuco dye used in the invention is preferably incorporated in a silver halide emulsion layer or a hydrophilic colloid layer adjacent to the emulsion layer. The leuco dye described above is preferably contained in an amount of $1\times10^{-6}$ to $5\times10^{-2}$ and more preferably $1\times10^{-5}$ to $2\times10^{-2}$ mol per mol of silver. In cases where contained in the layer adjacent to the emulsion layer, the leuco dye is incorporated in an amount, based on silver halide of the emulsion layer.

The leuco dye is dissolved in a water-miscible organic solvent, such as alcohols (e.g., methanol, ethanol, propanol or fluorinated alcohols), ketones (e.g., acetone or methyl ethyl ketone), dimethylformamide, dimethylsulfoxide, and methylcellosolve. Alternatively, the leuco dye is incorporated according to well known emulsion dispersing method, in which the leuco dye is dissolved using oils such as dibutyl phthalate, tricresyl phosphate, glyceryl triacetate and diethyl phthalate, or auxiliary solvents such as ethyl acetate and cyclohexane, and is mechanically emulsified. Furthermore, the leuco dye can be dispersed by the method known as a solid dispersion method, in which the dye powder is dispersed in water using a ball mill, colloid mill or ultrasonic homogenizer.

Silver halide emulsion

With respect to halide composition of silver halide emulsions used in the invention, any silver halide can be employed, including silver bromide, silver iodobromide, silver iodochlorobromide and silver chlorobromide. In terms of processability, an average overall iodide content of silver halide grains is preferably less than 3 mol %, more preferably less than 1.5 mol % and furthermore preferably 0.5 mol %. Silver iodide may be uniformly distributed within the grain or localized in the surface or inside of the grain.

Silver halide grains used in the invention are preferably monodisperse grains having a narrow grain size distribution. When a distribution width is defined as below Distribution width = (Standard deviation of grain size/Average grain size)

the distribution width is preferably 25% or less, more preferably 20% or less and furthermore 15% or less.

Of silver halide emulsions used in the invention, there are preferably employed core/shell type or double-structure grains which have different compositions between the internal portion and surface of the grain. The core/shell type grain emulsion can be prepared according to the method described in JP-A 59-177535, 59-178447, 60-35726 and 60-147727.

Silver halide grains used in the invention may contain dislocations. The dislocations can be directly observed using a transmission electron microscope at low temperature, as described in J. F. Mamilton, Phot. Sci. Eng. 11 57 (1967) and T. Shiozawa, J. Soc. Phot. Sci. Japan, 35 213 (1972). Silver halide grains are taken out from a silver halide emulsion while making sure not to exert any pressure that causes dislocation in the grain, and they are place on a mesh for electron microscopy. The sample is observed by transmission electron microscopy, while being cooled to prevent the grain from being damaged (e.g., printed-out) by electron beam. Since electron beam penetration is hampered as the grain thickness increases, sharper observations are obtained when using an electron microscope of high voltage type (e.g., over 200 KV for 0.25 $\mu$m thick grains).

The form of silver halide grains used in the invention is not specifically limited, including spheric grains, potato-like grains, cubic grains and tabular grains having an aspect ratio of 1.2 or more. The average grain size is not specifically limitative, and preferably 0.10 to 5.0 $\mu$m, more preferably 0.15 to 3.0 $\mu$m and furthermore preferably 0.2 to 2.0 $\mu$m. The tabular grains have preferably an average grain thickness of 0.01 to 1.0 $\mu$m, more preferably 0.02 to 0.60 $\mu$m and furthermore preferably 0.05 to 0.50 $\mu$m.

The silver halide grain size can be controlled by adjusting the temperature and flow rates of silver salt and halide solutions during the course of forming grains. At the stage of grain growth may be supplied silver halide fine grains, in place of supplying a silver ion-containing solution and a halide ion-containing solution. In this case, there can be supplied silver iodide, silver iodobromide, silver bromide, silver chlorobromide or silver chloride, singly or in combination, and further in combination with a silver ion-containing solution and halide ion-containing solution.

The light sensitive silver halide emulsion can be mixedly employed with a substantially light insensitive silver halide emulsion, such as fine internally-fogged grain emulsion or an emulsion having no sensitivity within the range of exposing light wavelengths. Two or more emulsions different in size or halide composition can be mixedly employed for the purpose of expanding exposure latitude.

The silver halide emulsion used in the invention may be any of surface latent image forming type, internal image forming type and surface and internal latent image forming type. To the silver halide emulsion, a cadmium salt, lead salt, zinc salt, thalium salt, iridium salt or its complex salt, rhodium salt or its complex salt, or iron salt or its complex salt can incorporated at the stage of grain formation or physical ripening.

As a method for chemical-ripening silver halide grains used in the invention, sulfur sensitization, gold sensitization or sensitization by use of noble metals of the periodic VIII group, reduction sensitization, sensitization by use of a chalcogen compounds, or combination thereof is preferably employed. Of these, a combination of gold sensitization and sulfur sensitization or gold sensitization and a selenium compound is preferred. The selenium compound can be used in any amount and is preferably used in combination with sodium thiosulfate, in chemical sensitization. A molar ratio of the selenium compound to sodium thiosulfate is preferably 2:1 or less and more preferably 1:1 or less. Further, a combination thereof with reduction sensitization is preferred.

Various kinds of selenium compound known in the art can be employed, as a selenium sensitizer, in selenium sensitization. Examples thereof include colloidal selenium metal, isocyanates (e.g., allyl isocyanate, etc.), selenoureas (e.g., N,N-dimethylselenourea, N,N,N'-triethylselenourea, N,N,N'-trimethyl-N'-heptafluoropropylcarbonylselenourea, N,N,N'-trimethyl-N'-nitrophenylcarbonylselenourea, etc.), selenoketones (e.g., selenoacetone, selenoacetophenone, etc.), selenoamides, (e.g., selenoacetoamide, N,N-dimethylselenobenzamide, etc.), selenocarboxylic acids and selenoesters (e.g., 2-selenopropionic acid, methyl-3-selenobutylate, etc.), selenophosphates (e.g., tri-p-triselenophosphate, etc.), and selenides (e.g., triphenylphosphineselenide, diethylselenide, diethyldiselenide, etc.). Of these, selenoureas, selenoamides, selenoketones and selenides are preferred.

The amount of the selenium sensitizer to be used depends on a selenium compound, silver halide grains or chemical-ripening conditions, and is generally $1\times10^{-8}$ to $1\times10^{-4}$ mol per mol of silver halide. The selenium compound may be incorporated through solution in water or an organic solvent such as methanol or ethanol, alone or in combination, according to propertied of the compound. Alternatively, the selenium may be incorporated in a manner such that it is previously mixed with a gelatin aqueous solution or emulsion-dispersed in a mixture solution of an organic solvent-soluble polymer.

The chemical ripening with a selenium sensitizer is preferably conducted at a temperature of 40° to 90° C. and more preferably 45° to 80° C. The pH and pAg thereof are 4 to 9 and 6 to 9.5, respectively.

It is preferred to supply iodide ions during or at the time of completing chemical sensitization, in terms of sensitivity and adsorption of a sensitizing dye. It is particularly preferred to add silver iodie in the form of fine grains.

Chemical sensitization is preferably conducted in the presence of a compound capable adsorbing to silver halide. Examples of the compound include azoles, diazoles, triazoles, tetrazoles, indazoles, thiazoles, pirimidines, azaindenes and these compounds containing a mercapto group or benzene ring.

The silver halide photographic material to be processed according to the invention may be subjected to reduction-sensitizing treatment. Silver halide emulsions are subjected to reduction sensitization by a method of adding a reducing compound, a method of a so-called silver ripening by passing through condition at a pAg of 1 to 7 and in excess of silver ions, or a method of so-called high pH ripening by passing through conditions at a high pH of 8 to 11. These methods may be employed in combination.

Addition of the reducing compound is preferable in terms of capability of finely-controlling an extent of reduction sensitization. The reducing compound may be any of an organic or inorganic compounds. Examples thereof include thiourea dioxide, stannous salts, amines or polyamines, hydrazine derivatives, formamidinesulfinic acids, silane compounds, borane compounds,ascorbic acid and its derivatives, and sulfites. The adding amount of the reducing compound depends on reducing ability of the compound, silver halide or preparation conditions such as dissolution condition, and is preferably $1\times10^{-8}$ to $1\times10^{-2}$ mol per mol of silver halide. The reducing compound is dissolved in water or an organic solvent such as alcohol, and added at a time of from grain growth to immediately before coating.

Silver halide grains can be spectrally sensitized with a sensitizing dye such as methine dyes. Usable dyes include cyanine dyes, merocyanine dyes, complex cyanine dyes, complex merocyanines, holo-polar cyanine dyes, hemicyanine dyes, styryl dyes and hemi-oxinol dyes. Of these, cyanine dyes, merocyanine dyes and complex cyanine dyes are preferred. The sensitizing dye can contain a variety of nuclei, such as pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, and these nuclei fused with an aliphatic hydrocarbon ring including indolenine nucleus, indole nucleus, benzoxazole nucleus, naphthooxazole nucleus, benzothiazole nucleus, naphthothiazole nucleus, benzoselenazole nucleus, benzoimidazole nucleus, quinoline nucleus. These nuclei may be substituted. Merocyanine dyes and complex merocyanine dyes can contain a 5 or 6-membered heterocyclic ring, as a nucleus having ketomethine structure, including a pyrazoline-5-one nucleus, thiohydantoin nucleus, 2-thiooxazolidine-2,4-dione nucleus, thiazoline-2,4-dione nucleus, rhodanine nucleus and thiobarbituric acid nucleus.

The sensitizing dye can be used singly or in combination thereof. The combination is often used for the purpose of supersensitization. Together with the sensitizing dye, there can be included in an emulsion layer, a dye having no spectral-sensitizing ability or material having no ability of absorbing visible light, those which exhibit supersensitizing action. Examples thereof include aminostilbene substituted by a nitrogen containing heterocyclic group, as described in U.S. Pat. Nos. 2,933,390 and 3,635,721, aromatic organic acid/formaldehyde condensates described in U.S. Pat. No. 3,743,510, cadmium salt and azaindene compounds. Combinations described in U.S. Pat. Nos. 3,615,613, 3,615,641, 3,617,295 and 3,635,721 are useful. The sensitizing dye can be added at any time of the process of nucleation, growth, desalting or chemical ripening, intermediate between these processed and before or after chemical ripening.

Dextran

In the invention, a dextran contained in a hydrophilic colloid layer a polymer of α-1,6-bonded D-glucose, which can be obtained by culturing dextran producing bacterias in the presence of succharides. Thus, dextran producing bacterias such as loconostock and mesenteleutus, or native dextran obtained by causing a cane sugar solution to act on dextran sucrase separated from a culture solution of the bacterias is subjected to partial degradation to belowered to a desired molecular weight. Mean weight-averaged molecular weight of a dextran used in the invention is 5,000 to 300,000, preferably 15,000 to 100,000 and more preferably 20,000 to 70,000.

The dextran can be incorporated in any of hydrophilic colloid layers and is preferably incorporated into a silver halide emulsion layer. In cases where another hydrophilic colloid layer except for the emulsion layer. it is preferably incorporated into a layer closer to the surface than the emulsion layer. When incorporated in the hydrophilic colloid layer, the dextran is preferably incorporated in an amount of 5 to 50% and more preferably 10 to 40% by weight based on binder contained in the hydrophilic colloid layer. Alternatively, the dextran is preferably incorporated in an amount of 0.3 g or more per $m^2$ of a photographic material, and more preferably 0.3 to 1.5 $g/m^2$.

Hydrophilic colloid and gelatin

As a hydrophilic colloid or binder used in the invention is preferably employed gelatin, but other hydrophilic colloids can also be employed. Examples thereof include gelatin derivatives, graft polymer of gelatin and another polymer, proteins such as albumin and casein, cellulose derivatives such as hydroxyethylcellulose, carboxymethylcellulose and cellulose sulfuric acid ester, saccharide derivatives such as sodium alginate, dextran and starch derivatives, and various kinds of synthetic polymeric materials of a polyvinyl alcohol and its partial acetal, poly-N-vinylpyrrolidone, polyacrylic acid, polymethacrylic acid, polyacrylamide, polyvinylimidazole, polyvinylpyrazole, and including their copolymers. Dextran or polyacrylamide having an average molecular weight of 5,000 to 100,000 is preferably used in combination with gelatin.

Examples of gelatin include lime-treated gelatin, acid-treated gelatin, enzime-treated gelatin described in Bull. Soc. Sci. Phot. Japan, Vol 16, page 30 (1966), and further gelatin derivatives modified with acid halides, acid anhydrides, isocyanates, bromoacetic acid, alakne saltones, vinylsulfonamides, maleic acid imides, polyalkyleneoxides or epoxy compounds.

Dyes

When a dye capable of being decolored or leached during processing is incorporated in at least one of silver halide emulsion layer(s) and other component layer(s), there can be obtained a highly sensitive photographic material with high sharpness and rapid processability. Dyes usable in photographic materials can be optimally selected from those which can enhance sharpness by absorbing desired wavelengths in response to requirements of the photographic material to remove effects of the wavelengths. It is preferred that the dye be decolored or leached out of the photographic material during processing and when the image is completed, that it reachs a in which residual coloring can be visually observed.

The dye is preferably added in the form of a solid fine particle dispersion. The solid fine particle dispersion of the dye can be prepared by using a surfactant and a dispersing means such as a ball mill, vibrating mill, sand mill, roller mill, jet mill or disc impeller mill. Dye dispersion can be prepared in a manner such that a dye is dissolved in an aqueous weak alkaline solution and is precipitated in the form of solid fine particles by lowering the pH of the solution to weak acidity or by simultaneously mixing an aqueous weak alkaline dye solution and an acidic aqueous solution to form solid fine particles. The dye can be used singly or in combination of two or more kinds thereof. When used in combination, dyes can be separately dispersed, followed by mixing, or simultaneously dispersed.

The dye is preferably incorporated into a silver halide emulsion layer, a layer closer to a support or both thereof and more preferably into a layer adjacent to the support. The dye is preferably high in concentration in the side closer to the support. The incorporated amount of the dye can be optionally varied in response to required sharpness. Thus, it is preferably incorporated in an amount of 0.2 to 20 $mg/m^2$ and more preferably 0.8 to 15 $mg/m^2$.

In the case of dyeing a silver halide emulsion layer, the dye is added into a silver halide emulsion or a hydrophilic colloid solution, which is coated, directly or through another hydrophilic colloid layer, onto the support.

As described above, the dye is preferably high in concentration in the closer side to the support. A mordant can be used to fix the dye in the closer side to the support. There can be used, e.g., non-diffusible mordant capable of holding the dye. There are known in the art a variety of methods of holding the dye together with the non-diffusible mordant, and it is preferred to hold them in a gelatin binder. Alternatively, they are held together in an appropriate binder and then dispersed in an aqueous gelatin solution by a means such as an ultrasonic homogenizer. The holding ratio depends on the kind of compounds to be used and is conventionally 0.1 to 10 parts by weight per 1 part by weight of a water-soluble dye. Since the dye is held together with the mordant, it can be used in an amount more than when used singly. There may further be provided a layer for incorporating the dye and mordant. The layer can be provided at any position and is preferably coated adjoining to the support.

Surfactant

As surfactants for use in preparing a solid particle dispersion of the dye is usable any of anionic surfactants, nonionic surfactants and cationic surfactants. There are preferably used anionic surfactants such as alkylsulfonates, alkylbenzenesulfonates, alkylnaphthalenesulfonates, alkylsulfonic acid esters, sulfosuccinic acid esters, sulfoalkylpolyoxyethylene alkylphenyl ethers and N-acyl-N-alkyltaurines, and nonionic surfactants such as saponin, alkyleneoxide derivatives and alkylesters of saccharide.

The amount of the anionic surfactant/nonionic surfactant to be used depends on the kin of the surfactant or conditions for dispersing the dye, and is conventionally 0.1 to 2000 mg. preferably 0.5 to 1000 mg and more preferably 1 to 500 mg per 1 g of a dye. Alternatively, the surfactant is used in an amount of 0.01 to 10% by weight and preferably 0.1 to 5% by weight in the dye dispersion. The surfactant is preferably added prior to the start of dispersing the dye, and if necessary, further added after dispersing. The anionic surfactant and/or the nonionic surfactant can be used singly or in combination of each or both.

Antihalation

In case where silver halide emulsion layer(s) are provided on one side of the support, there is generally provided a layer containing an antihalation dye. The antihalation dye containing layer may be provided between the emulsion layer and the support or on the opposite side to the emulsion layer, and preferably on the side opposite to the emulsion side in terms of freedom of selecting the dyes. A transmission density at exposing light wavelengths of the dye containing layer 0.4 to 1.5 and preferably 0.45 to 1.2. The dye is incorporated, depending on properties thereof, by adding in the form of an aqueous solution, micell dispersion or solid particle dispersion.

Lubricant

In the surface layer of photographic materials can be employed, as a lubricant, silicone compounds described in U.S. Pat. Nos. 3,489,576 and 4.047,958, colloidal silica described in JP-B 56-23139 (herein, the term, "JP-B" means examined and published Japanese Patent), parafin wax, higher fatty acid esters and starch derivatives. To photographic component layer(s) can be, as a plasticizer, polyols such as trimethylol propane, pentanediol, butanediol, ethylene glycol and glycerine.

Polymeric latex

Polymeric latexes can be incorporated into at least one of a silver halide emulsion layer and other component layers for enhancement of pressure resistance. As the polymeric latexes are preferably employed a homopolymer of an alkyl acrylate, its copolymer with acrylic acid or styrene-butadiene copolymer and a polymer which is comprised of monomer containing an active methylene group, water-solubilizing group or a group capable of cross-linking with gelatin, or its copolymer. There is preferably employed a copolymer which is comprised of a hydrophobic monomer, as main component, such as alkyl acrylate or styrene and monomer containing a water-solubilizing group or a group capable of cross-linking with gelatin to enhance miscibility with gelatin. Examples of the monomer containing a water-solubilizing group include acrylic acid, methacrylic acid, maleic acid, 2-acrylamido-2-methylpropane sulfonic acid and styrenesulfonic acid. Examples of the monomer containing a group capable of cross-linking with gelatin include glucidyl acrylate, glycidyl methacrylate and N-methylol acrylamide.

Matting agent

As matting agents usable in photographic materials can be employed particles of polymethylmethacrylate, copolymer of methylmethacrylate and methacrylic acid, organic compounds such as starch, or inorganic compounds such as silica, titanium dioxide, strontium sulfate and barium sulfate. The particle size is 0.6 to 10 $\mu$m and preferably 1 to 5 $\mu$m. Organic aggregate particles can also be employed as a matting agent. The organic aggregate particle is referred to as an aggregate comprised of primary particles with sizes of 0.05 to 0.50 $\mu$m, and having particle size of 1.0 to 20 $\mu$m. The shape of the particles may be sphere or irregular. An organic component is selected from alkylmethacrylates, alkylacrylates, fluorine- or silicon-substituted alkylmethacrylate, acrylates, and styrene, which may be a homopolymer or copolymer. Of these is preferable polymethyl methacrylate, such as GR-5 or GR-5P produced by Soken Kagaku Corp. The addition of 10 to 200 mg/m$^2$ is effective without causing haze.

Inorganic particles

Inorganic particles can be incorporated in a silver halide emulsion layer to enhance pressure resistance. The inorganic particles are mainly comprised of an oxide of a metal selected from silicon, aluminum, titanium, indium, yttrium, tin, antimony, zinc, nickel, copper, iron, cobalt, manganese, molybdenum, niobium, zirconium, vanadium, alkaline metals and alkaline earth metals. Of these, silicon oxide (colloidal silica), aluminum oxide, tin oxide, vanadium oxide and yttrium oxide are preferred in terms of transparency and hardness. The surface of the inorganic oxide may be treated with alumina, yttrium or cerium for enhancement of aqueous-dispersing stability as sol dispersed in water. To enhance miscibility with gelatin, the inorganic particles may be covered with shell of previously-cured gelatin. The amount of the inorganic particles to be added is 0.05 to 1.0 and preferably 0.1 to 0.7 of the weight of dried gelatin. The inorganic particles can be used in combination. The particle size of the inorganic particles is preferably 1 to 300 nm.

Aqueous-soluble Polymer

An aqueous-soluble polymer is preferably incorporated into photographic materials. Polyacrylamide described in U.S. Pat. No. 3,271,158, polyvinyl alcohol and polyvinyl pyrrolidone are effectively employed. Polysaccharides such as dextrin, saccharose and Pullulan are also effective. Of these are preferably employed polyacrylamide and dextrin, and more preferably dextrin. An average molecular weight of the polymer is preferably not more than 20,000 and more preferably not more than 10,000.

Photographic material

Silver halide light sensitive photographic materials used in the invention include black-and-white photographic materials (e.g., photographic materials for medical use, photographic materials for use in graphic arts, negative photographic material for general use, etc.), color photographic materials (e.g., color negative photographic materials, color reversal photographic materials, color photographic materials for print, etc.), diffusion transfer type photographic material and heat-processable photographic materials. Of these is preferred black-and-white photographic materials and particularly photographic materials for medical use. In the photographic materials used in the invention, a developing agent such as aminophenol, ascorbic acid, pyrocatechol, hydroquinone, phenylenediamine or 3-pyrazolidone may be incorporated in a silver halide emulsion layer or an adjacent layer thereto.

Hardener

It is preferred to incorporate an inorganic or organic hardener into a silver halide emulsion layer or a light insensitive hydrophilic colloid layer. Example thereof include chromium salts (e.g., chrome alum, chrome acetate), aldehydes (e.g., formaldehyde, glyoxal, glutar aldehyde), N-methylol compounds (e.g., dimethylol urea, methylol dimethylhydantoin), dioxane derivatives (e.g., 2,3-dihydroxydioxane), active vinyl compounds [e.g., 1,3,5-triacryloyl-hexahydro-s-triazine, bis(vinylsulfonyl)methyl ether, N,N'-methylenebis(β- (vinylsulfonyl)propioneamide], active halogen compounds (e.g., 2,4-dichloro-6-hydroxy-s-triazine), mucohalogenic acids (e.g., mucochloric acid, mucophenoxychloric acid), isooxazoles and 2-chloro-6-hydroxytriazinylated gelatin. These hardeners are used singly or in combination thereof. Of these hardeners are preferably used active vinyl compounds and active halogen compounds. Polymeric hardeners are also employed as an effective hardener. Examples thereof include dialdehyde starch, polymers containing an aldehyde group such as polyacrolein and acrolein copolymer, polymers containing an epoxy group, polymers containing a dichlorotriazine group, polymers containing active ester group, and polymers containing active vinyl group or its precursor. Of these is preferred a polymer in which an active vinyl group or its precursor is bonded through a long spacer to the main polymer chain.

Swelling of the photographic material during the process of developing, fixing and washing can be controlled by previously adding a hardener into the photographic material in the process of coating, whereby it is preferred to control a water content in the photographic material before drying. Swelling percentage of the photographic material during processing is preferably 150 to 250% and a swelling layer thickness is preferably not more than 70 μm. When the swelling percentage exceeds 250%, drying defects occur, resulting in transport problems in processing by an automatic processor, particularly in rapid-processing. When the swelling percentage is less than 150%, uneven development or residual coloring tends to occur. Herein, the swelling percentage is defined as a difference in layer thickness between before and after being swelled in processing solution(s), divided by a layer thickness before being swelled and multiplied by 100 (%).

Support

Examples supports used in the invention include those described in Research Disclosure 17643 (hereinafter, denoted as "RD-17643") page 28; and RD-308119, page 1009. An appropriate support is plastic resin films. The surface of the support may be provided with a subbing layer or subjected to corona discharge treatment or ultraviolet irradiation to improve adhesion property of the coating layer.

Other adjuvants

To a silver halide emulsion layer or another photographic component layer are included a variety of adjuvants in response to various objectives. Examples thereof are described in RD-17643 (December, 1978), RD-18716 (November, 1979) and RD-308119 (December, 1989), as shown below.

| | RD-17643 | | RD-18716 | RD-308119 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996–8 | IVA |
| Desensitizing dye | 23 | IV | 998 | IVB | |
| Dye | 25–26 | VIII | 649–650 | 1003 | VIII |
| Developing accelerator | 29 | XXI | 648 upper right | | |
| Antifoggant/ stabilizer | 24 | IV | 649 upper right | 1006–7 | VI |
| Brightening agent | 24 | V | | 998 | V |
| Hardening agent | 26 | X | 651 left | 1004–5 | X |
| Surfactant | 26–27 | XI | 650 right | 1005–6 | XI |
| Antistatic agent | 27 | XII | 650 right | 1006–7 | XIII |
| Plasticizer | 27 | XII | 650 right | 1006 | XII |
| Lubricant | 27 | XII | | | |
| Matting agent | 28 | XVI | 650 right | 1008–9 | XVI |
| Binder | 26 | XXII | | 1003–4 | IX |
| Support | 28 | XVII | | 1009 | XVII |

Processing

A developing agent used in the invention is preferably reductones represented by the following formula (A):

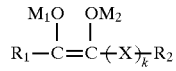

Formula (A)

wherein $R_1$ and $R_2$ independently represent a substituted or unsubstituted alkyl group, a substituted or unsubstituted amino group, a substituted or unsubstituted alkoxy group or alkylthio group, and $R_1$ and $R_2$ may combine with each other to form a ring; and k is 0 or 1; and when k is 1, X represents —CO—or —CS—. $M_1$ and $M_2$ each represent a hydrogen atom or an alkali metal atom.

In the formula (A), a compound formed by combination of $R_1$ and $R_2$ and represented by the following formula (A-a) is preferred:

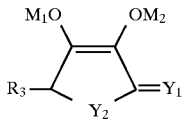

Formula (A-a)

wherein $R_3$ is a hydrogen atom, substituted or unsubstituted alkyl group, substituted of unsubstituted aryl group, substituted or unsubstituted amino group, substituted or unsubstituted alkoxy group, sulfo group, carboxyl group, amido group or sulfonamido group; $Y_1$ is O or S; $Y_2$ is O, S or $NR_4$, in which $R_4$ is a substituted or unsubstituted alkyl group or substituted or unsubstituted aryl group; and $M_1$ and $M_2$ each are a hydrogen atom or alkali metal atom.

As the alkyl group of formula (A) and formula (A-a) is preferred a lower alkyl group, such as an alkyl group having 1 to 5 carbon atoms; the amino group is preferably an unsubstituted amino group or amino group substituted by a lower alkoxy group; the alkoxy group is preferably a lower alkoxy group; the aryl group is preferably a phenyl group or naphthyl group; these groups may be substituted and as substituents are cited hydroxy group, halogen atom, alkoxy group, sulfo group, carboxy group, amido group, and sulfonamido group.

Examples of the compound represented by formulas (A) and (A-a) are shown below, but the present invention is not limited thereto.

Formula [A]

| Compound No. | X | $R_1$ | $R_2$ | $M_1$ | $M_2$ |
|---|---|---|---|---|---|
| A-1 | — (k = 0) | $HOCH_2-CH(OH)-CH(OH)-$ | $-OH$ | H | H |
| A-2 | — (k = 0) | $CH_3-CH(OH)-CH(OH)-$ | $-OH$ | H | H |
| A-3 | — (k = 0) | $HOCH_2-CH(OH)-CH(OH)-$ | $-CH_3$ | H | H |
| A-4 | — (k = 0) | $CH_3-CH(OH)-CH(OH)-$ | $-CH_3$ | H | H |
| A-5 | $-C(=O)-$ (k = 1) | $HOCH_2-CH(OH)-CH(OH)-$ | $-OH$ | H | H |
| A-6 | $-C(=O)-$ (k = 1) | $CH_3-CH(OH)-CH(OH)-$ | $-OH$ | H | H |
| A-7 | $-C(=S)-$ (k = 1) | $HOCH_2-CH(OH)-CH(OH)-$ | $-OH$ | H | H |
| A-8 | $-C(=S)-$ (k = 1) | $CH_3-CH(OH)-CH(OH)-$ | $-OH$ | H | H |
| A-9 | $-C(=O)-$ (k = 1) | $HO-CH_2-$ | $-OH$ | Na | H |
| A-10 | $-C(=O)-$ (k = 1) | $HO-CH_2-$ | $-CH_3$ | H | H |
| A-11 | $-C(=O)-$ (k = 1) | $HO-CH_2-$ | $-C_2H_5$ | H | H |
| A-12 | $-C(=O)-$ (k = 1) | $HO-CH_2-$ | $-C_2H_4OH$ | H | Na |

Formula [A-a]

| Compound No. | $Y_1$ | $Y_2$ | $R_3$ | $M_1$ | $M_2$ |
|---|---|---|---|---|---|
| A-13 | O | O | H | H | H |
| A-14 | O | O | $CH_3$ | H | H |
| A-15 | O | O | $CH_2(OH)$ | H | H |
| A-16 | O | O | $CH_3-CH(OH)-$ | H | H |
| A-17 | O | O | $HOCH_2-CH(OH)-$ | H | H |
| A-18 | O | O | $CH_3-CH(OH)-$ | Na | H |
| A-19 | O | O | $HOOCCH_2-CH(OH)-$ | H | Na |

-continued

Formula [A-a]

| Compound No. | $Y_1$ | $Y_2$ | $R_3$ | $M_1$ | $M_2$ |
|---|---|---|---|---|---|
| A-20 | S | O | H | Na | H |
| A-21 | S | O | $CH_3-CH(OH)-$ | H | H |
| A-22 | S | O | $HOCH_2-CH(OH)-$ | H | H |
| A-23 | O | $NCH_3$ | H | H | H |
| A-24 | O | NH | $HOCH_2-CH(OH)-$ | H | K |
| A-25 | O | S | H | H | H |
| A-26 | O | S | $HOCH_2-CH(OH)-$ | H | H |

-continued

Formula [A-a]

| Compound No. | $Y_1$ | $Y_2$ | $R_3$ | $M_1$ | $M_2$ |
|---|---|---|---|---|---|
| A-27 | O | S | $CH_3-\underset{\underset{OH}{\vert}}{CH}-$ | H | H |
| A-28 | S | S | H | H | H |
| A-29 | S | S | $HOCH_2-\underset{\underset{OH}{\vert}}{CH}-$ | H | H |
| A-30 | S | S | H | H | H |

These compounds are exemplarily ascorbic acid, erythorbic acid or derivatives derived therefrom, being commercially available and readily synthesized by a well known method. When using a developing solution containing the above-described reductones, there were effects of improving silver image tone, which was not achieved by conventional development. The reductone is contained preferably in an amount of 0.005 to 0.5 mol and more preferably 0.01 to 0.3 mol per liter of developing solution.

The above-described reductone as a developing agent may be employed in combination with an auxiliary developing agent. Examples thereof include hydroquinone, p-aminophenols such as p-aminophenol, N-methyl-p-aminophenol and 2,4-diaminophenol, 1-phenyl-3-pyrazolidones such as 1-phenyl-3-pyrazolidone, 1-phenyl-4-methyl-4-hydroxymethyl-3-pyrazolidone and 5,5-dimethyl-1-phenyl-3-pyrazolidone. Of these are preferably employed p-aminophenols or 3-pyrazolidones. These auxiliary developing agents are employed singly or in combination thereof.

The auxiliary developing agent is employed in an amount of 0.001 to 0.1 mol per liter of developing solution.

As a preservative is contained sulfites such as potassium sulfite and sodium sulfite or reductones such as piperidinohexose reductone. These are preferably contained in an amount of 0.2 to 1 mol/l and more preferably 0.3 to 0.6 mol/l. Addition of a large amount of ascorbic acid leads to improved processing stability.

As examples of an alkaline agent including a pH adjusting agent are cited sodium hydroxide, potassium hydroxide, sodium carbonate, potassium carbonate, sodium phosphate and potassium phosphate. There may also be employed buffering agents such as a borate described in JP-A 61-28708, saccharose described in JP-A 60-93439, acetoxime, 5-sulfosalycylic acid, phosphate and carbonate. The content of these chemicals are selected so as to make the pH of a developing solution 9.0 to 13 and preferably 10 to 12.5.

There may be contained a dissolution aid such as polyethylene glycols or esters thereof, a sensitizing agent such as quaternary ammonium salts, a development accelerating agent and a surfactant. There is also employed an agent for preventing silver sludge, such as an anti-silver-stain agent described in JP-A 56-106244, sulfide or disulfide compounds described in JP-A 3-51844 and cysteine derivatives or triazine compounds described in Japanese Patent Application No. 4-92947.

As restrainers are employed azole type organic restrainers including indazole type, imidazole type, benzimidazole type, triazole type, benztriazole type, tetrazole type and thiadiazole type. Examples of an inorganic restrainer include sodium bromide, potassium bromide and potassium iodide. Besides, there may be employed compounds described in L. F. A. Mason, "Photographic Processing Chemistry"published by Focal Press (1966), page 226-229; U.S. Pat. Nos. 2,193,015 and 2,592,364; and JP-A 48-64933. As a chelating agent for sequestering calcium ions contained in tap water used for preparing processing solution solutions is an organic chelating agent described in JP-A 1-193853, which has 8 or more of a stability constant of a Fe-chelate. Examples of an inorganic chelating agent include sodium hexametaphosphate, calcium hexametaphosphate and polyphosphates.

Dialdehyde compounds can be employed as a hardener in a developer. In this case, glutar aldehyde is preferably employed, provided that inclusion of the hardener in a photographic material is preferred for rapid processing rather than addition into a developer.

Developing temperature is preferably 25° to 50° C. and more preferably 30° to 40° C. Developing time is 3 to 90 sec. and preferably 5 to 60 sec. The total processing time (i.e., Dry to Dry) is 15 to 210 sec.

Replenishment is made for compensating exhaustion due to processing solutions and aerial oxidation. Examples of replenishing methods include replenishment based on width and transport speed described in JP-A 55-12624; area-replenishment described in JP-A 60-104946; and area-replenishment controlled by the number of continuously-processing sheets, as described in JP-A 1-149156. The replenishing rate is preferably not more than 200 ml and more preferably 80 to 160 ml/$m^2$.

A fixing solution contains fixing chemicals known in the art. The pH of the fixing solution is not less than 3.8 and preferably 4.2 to 5.5. Examples of a fixing agent include thiosulfates such as ammonium thiosulfate and sodium thiosulfate. Ammonium thiosulfate is preferable in terms of the fixing speed. The concentration of ammonium thiosulfate is preferably 0.1 to 5 mol/l and more preferably 0.8 to 3 mol/l. The fixing solution may be acid hardening one. Aluminum ions are employed as a hardener and added in the form of aluminum sulfate, aluminum chloride or potassium alum, provided that inclusion of the hardener in a photographic material is preferred for rapid processing rather than addition into a fixing solution. The fixing solution may further contain a preservative such as sulfites or bisulfites, pH-buffering agent such as acetic acid or boric acid, pH-adjusting agents including various acids such as mineral acid (e.g., sulfuric acid, nitric acid) organic acid (e.g., citric acid, tartaric acid, malic acid), and hydrochloric acid, and metal hydroxides (e.g., potassium hydroxide, sodium hydroxide) and a chelating agent capable of water-softening.

It is preferred that the above-described processing chemicals are prepared in the form of solid processing composition, which is employed through as a processing solution.

Next, solidification of photographic processing composition will be explained. The processing composition can be solidified in such a manner that the processing composition in the form of a concentrated solution, fine powder or granules is mixed with a water soluble bonding agent and then the mixture is molded, or the water soluble bonding agent is sprayed on the surface of temporarily-molded processing composition to form a covering layer, as described in JP-A 4-29136, 4-85533, 4-85534, 4-85535, 4-85536 and 4-172341.

Further, the solid composition is preferably in the form of a tablet. A preferred tablet-making process is to form a tablet by compression-molding after granulating powdery processing composition. As compared to a solid composition prepared simply by mixing the processing composition to form a table, there is an advantage that improvements in solubility and storage stability were achieved and resultingly, the photographic performance becomes stable. As for granulation process which is carried out prior to tablet-making process, any conventionally known method such as fluidized-bed granulation process, extrusion granulation process, compression granulation process, crush granulation process, fluid layer granulation process, and spray-dry granulation process can be employed. It is preferred that the average grain size of the granules is 100 to 800 μm and preferably 200 to 750 μm. In particular, 60% or more of the granules is with a deviation of ±100 to 150 μm. When the grain size smaller, it tends to cause localization of mixing elements and therefore, is undesirable. As hydraulic press machine, any conventional compression molding machine, such as a single-engine compression molding machine, rotary-type compression machine, briquetting machine, etc. may be employed to form a tablet. Compression-molded (compression-tableted) solid processing composition may take any form and is preferably in a cylindrical form from the point of productivity, handleability and problems of powder dust in cases when used in user-side. It is further preferred to granulate separately each component, such as an alkali agent, reducing agent and preservative in the above process.

The solid processing composition in the form of a tablet can be prepared according to the methods, as described in JP-A 51-61837, 54-155038, 52-88025, and British Patent No. 1,213,808. The granular processing composition can also be prepared according to methods. as described in JP-A 2-109042, 2-109043, 3-39735 and 3-39739. The powdery processing composition can be prepared according to methods, as described in JP-A 54-133332, British Patent No. 725,892 and 729,862 and German Patent No. 3,733,861.

A bulk density of the above-described solid processing composition is preferably 1.0 to 2.5 g/cm$^3$ in terms of solubility and effects of the invention. When being not less than 1.0 g/cm$^3$, it is advantageous for strength of the solid composition; and when being not more than 2.5 g/cm$^3$, it is advantageous for solubility. In the case of the developing or fixing composition in the form of granules or powder, its bulk density is preferably 0.40 to 0.95 g/cm$^3$.

EXAMPLES

Examples of the present invention will be described below, but embodiments of the present invention are not limited to these examples.

Experiment 1 preparation of seed grain emulsion

To 0.05N potassium bromide aqueous solution containing gelatin treated with hydrogen peroxide with vigorously stirring at 40° C. are simultaneously added equimolar silver nitrate aqueous solution and potassium bromide aqueous solution containing gelatin treated with hydrogen peroxide by the double jet method. At 1.5 min. after completing addition, the temperature of the reaction mixture was lowered to 25° C. taking 30 min. and ammonia water (28%) was added thereto in an amount of 80 ml per mol of silver nitrate and then further stirred for 5 min. After adjusting the pH of the mixture to 6.0, the mixture was desalted using an aqueous solution of Demol N (trade name, produced by Kao-Atlas Co.) and magnesium sulfate aqueous solution to remove soluble salts and redispersed using a gelatin aqueous solution. The resulting seed grain emulsion was comprised of sphere grains with an average grain size of 0.23 μm and a coefficient of variation of grain size of 0.28.

Preparation of Em-1

Using the above-obtained seed grain emulsion, silver halide grains were grown as follows. To an aqueous solution containing ossein gelatin and disodium polypropyleneoxy-polyethyleneoxy-disuccinate with vigorously stirring at 75° C. were added a silver nitrate aqueous solution and an aqueous solution containing potassium bromide and potassium iodide by the double jet method, while the pH and pAg were maintained at 5.8 and 9.0, respectively. After completing addition, the pH was adjusted to 6.0 and a sensitizing dye, 5,5'-dichloro-9- ethyl-3,3'-di(3-sulfopropyl)-oxacarbocyanine sodium salt was added thereto in an amount of 400 mg/mol of silver. The mixture was desalted using an aqueous solution of Demol N (trade name, produced by Kao-Atlas Co.) and magnesium sulfate aqueous solution to remove soluble salts and redispersed using a gelatin aqueous solution. Thus, a silver iodobromide tabular grain emulsion was obtained, comprising tabular grains having an average iodide content of 0.5 mol %, an average circle-equivalent diameter of 0.96 μm, variation coefficient of grain size of 0.25 and an aspect ratio (circle-equivalent diameter/grain thickness) of 4.5. The resulting emulsion was denoted as Em-1.

Chemical sensitization of emulsion

Subsequently, the emulsion (Em-1) was raised to 60° C., and after adding a sensitizing dye of 5,5'-ditrifluoromethyl-1,1', 3-triethyl-3'-(3-sulfopropyl)benzo-imidazolocarbocyanine anhydride in an amount of 0.7 mmol per mol of silver and in the form of a solid particle dispersion, an aqueous solution of ammonium thiocyanate, chloroauric acid and sodium thiosulfate and a solution of triphenylphosphine selenide dissolved in a mixture of methanol and ethyl acetate were added thereto and chemical ripening was conducted over period of 2 hr. After completing chemical ripening, stabilizer 4-hydroxy-6-methyl-1,3,3a,7-tetraazaindene (TAI) was added. Besides the sensitizing dye, adjuvants were further added in the following amounts (per mol of silver halide).

| | |
|---|---|
| Potassium thiocyanate | 95 mg |
| Chloroauric acid | 2.5 mg |
| Sodium thiosulfate | 2.0 mg |
| Triphenylphosphine selenide | 0.2 mg |
| Stabilizer (TAI) | 280 mg |

The solid fine particle dispersion of the sensitizing dye was prepared in accordance with JP-A 5-297496. Thus, a given amount of the sensitizing dye was added to water kept at 27° C. and stirred by means of a high-speed stirrer (dissolver) at 3,500 rpm over a period of 30 to 120 min.

A dispersion of the above-described selenium sensitizer was prepared in the following manner. Thus, 120 g of triphenylphosphine selenide was added to 30 kg of ethyl acetate kept at 50° C. and dissolved with stirring. On the other hand, 3.8 kg of gelatin was dissolved in 38 kg of water and further added thereto 93 g of a 25 wt. % aqueous solution of sodium dodecylbenzenesulfonate. Then, these two solutions were mixed and dispersed by a high-speed stirring type dispersing machine provided with a dissolver having a diameter of 10 cm at 50° C. and a dispersing blade-speed of 40 m/sec over a period of 30 min. Then, stirring was continued under reduced pressure to remove ethyl acetate until the residual ethyl acetate reached 0.3 wt % or less. The dispersion was diluted with water to make 80 kg. A part of the thus prepared dispersion was used for the above-described experiment.

To thus sensitized emulsion Em-1 were added adjuvants as described below to prepare a coating solution for an emulsion layer. Concurrently, a coating solution for a protective layer was also prepared. A dextran having an average molecular weight of 40,000 was added to the coating solution in amounts as shown in Table 1. The coating solutions were coated simultaneously on both sides of a support so as to have a silver amount of 1.7 g/m$^2$ and gelatin amount of 2.5 g/m$^2$ per one side, in which the gelatin amount of a protective layer is 0.9 g/m$^2$), and dried to obtain a photographic material sample. As a support was employed a polyethylene terephthalate film with a thickness of 175 $\mu$m, blue-tinted with density of 0.15 and coated on both sides with a subbing solution containing a filter dye as below and gelatin dispersed in a 10% aqueous dispersion of a copolymer comprised of monomers of 50 wt % of glycidyl methacrylate, 10 wt % of methylmethacrylate and 40 wt % of butylacrylate.

Filter dye

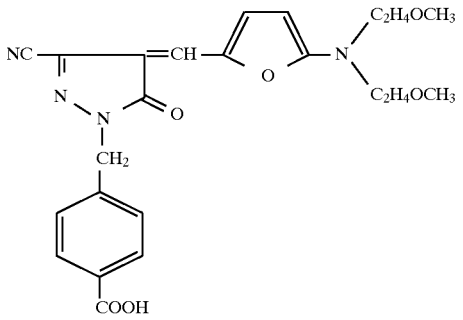

Adjuvants added to the silver halide emulsion was as follows. The adding amount is expressed as per mol of silver halide.

| | |
|---|---|
| 1,1-Dimethylol-1-brom-1-nitromethane | 70 mg |
| Polyvinyl pyrrolidone (M.W. 10,000) | 1.0 g |
| Copolymer of styrene/anhydrous maleic acid | 2.5 g |
| Nitrophenyl-triphenylphosphonium chloride | 50 mg |
| $C_4H_9OCH_2CH(OH)CH_2N(CH_2COOH)_2$ | 1.0 g |
| 1-Phenyl-5-mercaptotetrazole | 15 mg |
| Leuco dye as shown in Table 1 | |

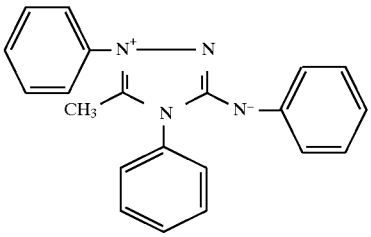

150 mg

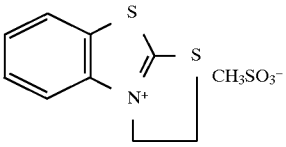

70 mg

The protective layer coating solution was prepared as follows. Adjuvants are expressed in amounts per liter of the coating solution.

| | |
|---|---|
| Lime-processed inert gelatin | 68 g |
| Acid-processed gelatin | 2.0 g |
| Sodium-isoamyl-n-decylsulfosuccinate | 0.1 g |
| Polymethyl methacrylate (matting agent with average particle size of 3.5 $\mu$m) | 1.1 g |
| Silicon dioxide particles (matting agent with an area-average size of 1.2 $\mu$m) | 0.5 g |
| $(CH_2=CHSO_2CH_2)_2$ (hardener) | 500 mg |
| $C_4F_9SO_3K$ | 2.0 mg |
| $C_{12}H_{25}CONH(CH_2CH_2O)_5H$ | 2 g |

-continued

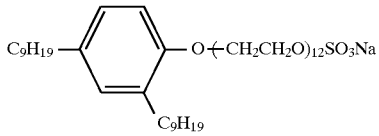

1.0 g

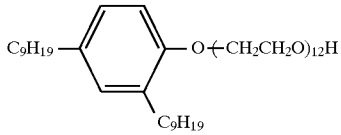

0.4 g

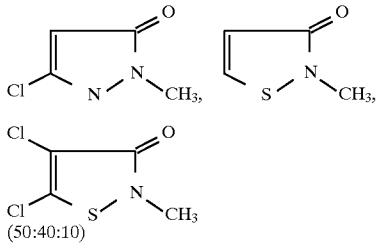

0.1 g

Solid processing compositions were prepared in the following manner.

Solid developing composition

Preparation of granules (A1)

1-Phenyl-3-pyrazolidone of 500 g, N-actyl-D,L-penicillamine of 10 g and sodium glutaraldehyde bissulfite of 1000 g each were pulverized up in a commercially available mill so as to have an average particle size of 10 $\mu$m. To the resulting fine particles, were added 300 g of DTPA-5Na, 300 g of Dimezone S, 4000 g of sodium erythorbate, 2,000 g of sodium sulfite, 7.0 g of 1-phenyl-5-mercaptotetrazole and 400 g of D-mannit, and the mixture was mixed in the mill for 30 min. In stirring granulator commercially available, the resulting mixture was granulated for 10 min. at room temperature by adding 30 ml of water. The resulting granules were dried up at 40° C. for 2 hr. in a fluidized bed drier so that the moisture content of the granules was almost completely removed off.

Preparation of Granules (B1)

Potassium carbonate of 10000 g and sodium bicarbonate of 1000 g each were pulverized up in a commercially available mill so as to have an average particle size of 10 $\mu$m. To the resulting fine particles, was added D-mannit of 800 g was added and the mixture was mixed in the mill for 30 min. In stirring granulator commercially available, the resulting mixture was granulated for 15 min. at room temperature by adding 30 ml of water. The resulting granules were dried up at 40° C. for 2 hr. in a fluidized bed drier so that the moisture content of the granules was almost completely removed off.

Preparation of solid developing composition

To the thus prepared granules (A1) and (B1) was added 100 g of sodium laurylsulfate and mixed for 10 min. by making use of a mixer in a room controlled to be not higher than 25° C. and 40% RH. The mixture was compression-tableted so as to have a filling amount of 10 g per tablet, by making use of a tableting machine that was modified model of Tough Press Collect 1527HU manufactured by Kikusui Mfg. Works, Inc to obtain a developing composition in the form of a tablet. The developing composition in the form of a tablet were packaged into a pillow bag containing aluminum for moisture-proof, in an amount for 3 liters of the developing solution.

A solid fixing composition was prepared in the following manner.

Solid fixing composition

Granules (A2)

Ammonium thiosulfate/sodium thiosulfate (90/10 by weight) of 15,000 g, β-alanine of 1,500 g sodium acetate of 4,000 g were each pulverized up in a commercially available mill so as to have an average particle size of 10 μm. To the resulting fine particles, were added sodium sulfite 500 g and binder mannitol of 1,300 g and the mixture was mixed in the mill for 3 min. In stirring granulator commercially available, the resulting mixture was granulated by adding 50 ml of water. The resulting granules were dried up at 40° C. in a fluidized bed drier so that the moisture content of the granules was almost completely removed off.

Granules (B2)

Boric acid of 700 g, aluminum sulfate octadecahydrate of 1,500 g and cinnamic acid of 1,200 g each were pulverized up in a commercially available mill so as to have an average particle size of 10 μm. To the resulting fine particles, was added sodium hydrogensulfate of 200 g and, in stirring granulator commercially available, the resulting mixture was granulated by adding 30 ml of water. The resulting granules were dried up at 40° C. in a fluidized bed drier so that the moisture content of the granules was almost completely removed off.

Preparation of solid fixing composition

To the thus prepared granules (A2) and (B2) was added sodium laurylsulfate of 150 g and mixed for 10 min. by making use of a mixer in a room controlled to be not higher than 25° C. and 40% RH. The mixture was compression-tableted so as to have a filling amount of 10. g per tablet by making use of a tableting machine that was modified model of Tough Press Collect 1527HU manufactured by Kikusui Mfg. Works, Inc. Thus prepared fixing composition in the form of a tablet were packaged into a pillow bag containing aluminum for moisture-proof, in an amount for 3 liters of the fixing solution.

A starting developer solution in a developing tank was prepared so as to dissolve 15 tablets of developing composition-tablet in water to make a total amount of 1 liter. Thus prepared developing solution of 7.8 l was introduced into a processor SRX-201 (product by Konica Corp.) and a starter having the composition as below was added thereto in amount of 40 ml/l to prepare a starting developing solution. A fixing solution for use in the processor was prepared so as to dissolve 21 tablets of fixing composition-tablets in water to make a total amount of 1 liter. Thus prepared fixing solution of 5.6 1 was introduced into a processor SRX-201 as a starting fixer solution.

| Starter | |
|---|---|
| KBr | 3.5 g |
| $CH_3N(C_2H_6NHCONHC_2H_4SC_2H_5)_2$ | 0.05 g |
| Methyl-β-cyclodextrin | 5.0 g |
| Sodium metabisulfite for pH-adjustment | |
| Water to make | 40 ml |

Opened package of solid developing or fixing composition tablets was set at the inlet of modified chemical mixer and at the same time when the tablets was supplied into the tank, warm water (25° to 30° C.) was also introduced to prepare the processing solution of 3.0 liter, with stirring and dissolving for 25 min. The resulting solution was used as a replenishing solution for developing or fixing solution. The pH of the developing solution and fixing solution was respectively adjusted to 10.0 and 4.80 with sulfuric acid or potassium hydroxide. When the starter was added, the pH of the developing solution was 9.90.

The replenishing rate of developer or fixer was 180 ml per $m^2$ of photographic material.

Experiment 2

Processing was carried out in the same manner as in Experiment 1, except that a developing solution was replaced by one having the following composition.

| Developer formula | |
|---|---|
| Part-A (to make 15 liters) | |
| Potassium hydroxide | 470 g |
| Potassium sulfite (50% solution) | 3000 g |
| Sodium hydrogen carbonate | 150 g |
| Diethylenetriaminepentaacetate 5Na | 45 g |
| 5-Methylbenzotriazole | 2 g |
| 1-Phenyl-5-mercaptotetrazole | 0.2 g |
| Hydroquinone | 390 g |
| Water to make | 5000 ml |
| Part-B (to make 15 liters) | |
| Glacial acetic acid | 220 g |
| Triethyleneglycol | 200 g |
| 1-Phenyl-3pyrazolidone | 27 g |
| 5-Nitroindazole | 0.45 g |
| n-Acetyl-DL-penicillamine | 0.15 g |

Part-A and B are mixed with adding water to make a total volume of 15 liters.

| Starter formula (to make 1 liter) | |
|---|---|
| Glacial acetic acid | 138 g |
| Potassium bromide | 325 g |
| 5-Methylbenzotrizole | 1.5 g |
| Water to make | 1 liter |

Herein, processing of Experiment 1 refers to Processing (1) and processing of Experiment 2 refers to processing (2).

Evaluation of contrast (Continuous-processing stability)

Each sample was sandwiched between two sheets of radiographic intensifying screens, KO-250 and exposed, through an aluminum wedge, to X-ray at a tube voltage of 80 kVp and tube current of 100 mA for 0.05 sec. Then exposed samples were processed by a modified of roller transport type processor SRX-502 (product of Konica), using the following developer and fixer. Contrast was represented by a slope (tan α) of a line connecting a density of 1.0 and that of 2.0 on a characteristic curve. Photographic film sheets with a size of 10×12 inch, which were overall exposed so as to a density of 1.0, were continuously processed. At the time the number of processed sheets reached 10, 200 or 500, contrast was each evaluated.

Evaluation of silver image color

After exposed so as to give a density of 1.2, samples were processed in the same manner as in sensitometry. Processed samples were observed on the viewing box having a color temperature of 7700° K and illuminance of 11600 lux and visually evaluated with respect to silver image color through transmitted light, based on the following criteria:

5: Neutral black with no yellowish tone

4: Not completely neutral black but not yellowish

3: Partially yellowish black observed

2: Overall slightly yellowish tone observed

1: Apparently yellowish tone

The processed samples used for evaluation of silver image tone as above were each allowed to stand at 50° C. and 80% RH over a period of 3 days, and again evaluated with respect to silver image tone. Results thereof are shown in Table 1.

TABLE 1

| Sample No. | Dextran Amt (g/m$^2$) | Dextran Layer | Leuco Dye Dye | Leuco Dye Amt. (mol/Agmol) | Processing | Contrast 10 | Contrast 200 | Contrast 500 | Silver image color Before aging | Silver image color After aging | Remark |
|---|---|---|---|---|---|---|---|---|---|---|---|
| 1 | — | | — | — | (2) | 2.15 | 2.05 | 1.70 | 4 | 4 | Comp. |
| 2 | — | | — | — | (1) | 2.20 | 2.10 | 1.95 | 3 | 3 | Comp. |
| 3 | 0.5 | Em | — | — | (1) | 2.30 | 2.25 | 2.25 | 2 | 2 | Comp. |
| 4 | 0.2 | Em | I-1 | $5.0 \times 10^{-4}$ | (1) | 2.20 | 2.10 | 2.05 | 5 | 5 | Inv. |
| 5 | 0.5 | Em | I-1 | $5.0 \times 10^{-4}$ | (1) | 2.30 | 2.25 | 2.25 | 5 | 5 | Inv. |
| 6 | 0.8 | Em | I-1 | $5.0 \times 10^{-4}$ | (1) | 2.35 | 2.30 | 2.30 | 5 | 5 | Inv. |
| 7 | 0.5 | Em | I-1 | $5.0 \times 10^{-4}$ | (2) | 2.25 | 2.20 | 2.20 | 5 | 3 | Comp. |
| 8 | 0.5 | Em | I-1 | $5.0 \times 10^{-4}$ | (1) | 2.25 | 2.25 | 2.15 | 5 | 5 | Inv. |
| 9 | 0.5 | Em | III-3 | $5.0 \times 10^{-4}$ | (1) | 2.30 | 2.25 | 2.25 | 5 | 5 | Inv. |
| 10 | 0.5 | Em | VI-1 | $5.0 \times 10^{-4}$ | (1) | 2.30 | 2.25 | 2.20 | 5 | 5 | Inv. |
| 11 | 0.4 | Em | VII-1 | $5.0 \times 10^{-4}$ | (1) | 2.30 | 2.30 | 2.25 | 5 | 5 | Inv. |
| | 0.2 | Pro | | | | | | | | | |

*Em: Emulsion layer
Pro: Protective layer

According to the invention, there can be provided a processing method of a silver halide light sensitive photographic material, which performs, with little variation of photographic performance, superior silver image tone and e lasting quality.

What is claimed is:

1. A method for processing a silver halide light sensitive photographic material comprising a support having thereon hydrophilic colloid layers including a silver halide emulsion layer and a light insensitive layer, the method comprising the steps of:

imagewise exposing the photographic material developing the photographic material with a developer and fixing the photographic material with a fixer, wherein at least one of said hydrophilic colloid layers contain a dextran and said silver halide emulsion layer or a hydrophilic colloid layer adjacent to said silver halide emulsion layer contains a leuco dye, said developer containing a reductone, as a developing agent.

2. The processing method of claim 1, wherein said leuco dye is a compound represented by the following formula (I) through (VII):

Formula (I)

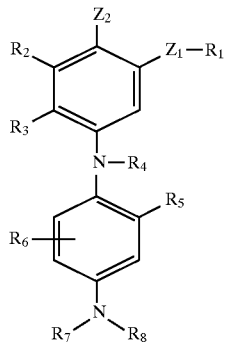

-continued

Formula (II)

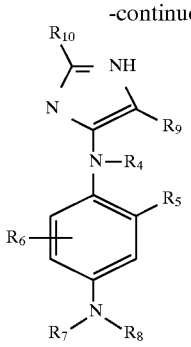

Formula (III)

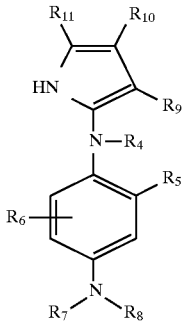

Formula (IV)

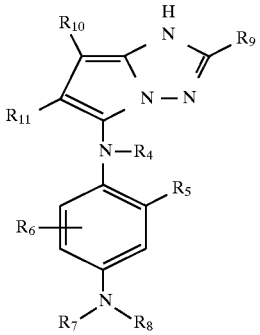

-continued

Formula (V)

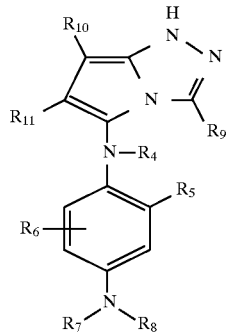

Formula (VI)

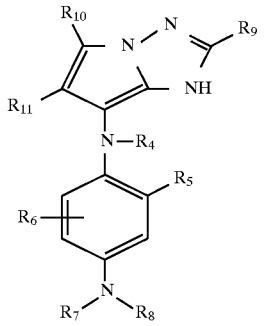

Formula (VII)

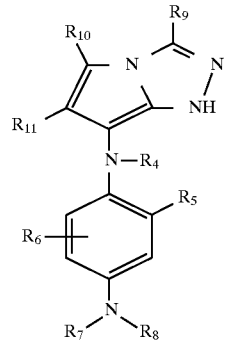

wherein $Z_1$ represents —NHCO—, —CONH— or —NHCONH—; $Z_2$ represents —OH or —$NHSO_2R_{12}$, in which $R_{12}$ represents an alkyl group or an aryl group; $R_1$ represents an aryl group of a heterocyclic group, and $R_2$ represents a hydrogen atom, an alkyl group or a halogen atom, or $R_2$ and $R_3$ combine with each other to form a ring; $R_3$ represents a hydrogen atom, an alkyl group or an acylamino group; $R_4$ represents a hydrogen atom, —$COR_{13}$, or —$SO_2R_{13}$, in which $R_{13}$ represents an alkyl group or an aryl group; $R_5$ , and $R_6$ independently represent a hydrogen atom, an alkyl group, an alkoxy group, an acylamino group or a halogen atom; $R_7$ and $R_8$ independently represent a hydrogen atom, an alkyl group, an aryl group or an acyl group, or $R_7$ and $R_8$ may represent the carbon atoms necessary to form a fused ring with the phenyl ring to which the N atom is attached or $R_7$ and $R_8$ may combine with each other to form a 5 or 6-membered nitrogen-containing heterocyclic ring; $R_9$, $R_{10}$ and $R_{11}$ independently represent a hydrogen atom or a substituent, provided that $R_{10}$ and $R_{11}$ may combine with each other to form a ring.

3. The processing method of claim 1, wherein said dextran is contained in an amount of not less than 0.3 g per $m^2$ of the photographic material.

4. The processing method of claim 1, wherein said reductone is a compound represented by the following formula:

Formula (A)

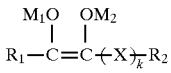

wherein $R_1$ and $R_2$ independently represent an alkyl group, an acyl group, an alkoxy group or an alkylthio group, provided that $R_1$ and $R_2$ may combine with each other to form a ring; X represents —CO— or —CS—; and k is 0 or 1.

5. The processing method of claim 4, wherein said reductone is a compound represented by the following formula:

Formula (A-a)

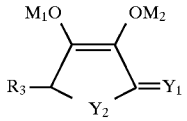

wherein $R_3$ represents a hydrogen atom, an alkyl group, an aryl group, an amino group, an alkoxy group, a sulfo group, a carboxy group, an amido group or a sulfonamido group; $Y_1$ represents O or S; $Y_2$ represents O, S or $NR_4$, in which $R_4$ represents an alkyl group or an aryl group; and $M_1$ and $M_2$ represents a hydrogen atom or an alkali metal.

* * * * *